US011353019B2

(12) United States Patent
Danielsson

(10) Patent No.: US 11,353,019 B2
(45) Date of Patent: Jun. 7, 2022

(54) ROTARY PUMP WITH ROTOR BEARING RING

(71) Applicant: The Bricks Groupe, LLC, St. Petersburg, FL (US)

(72) Inventor: Carl Magnus Danielsson, Marietta, GA (US)

(73) Assignee: The Bricks Groupe, LLC, Kennesaw, GA (US)

( * ) Notice: Subject to any disclaimer, the term of this patent is extended or adjusted under 35 U.S.C. 154(b) by 120 days.

(21) Appl. No.: 17/004,274

(22) Filed: Aug. 27, 2020

(65) Prior Publication Data

US 2022/0065246 A1 Mar. 3, 2022

(51) Int. Cl.

| | |
|---|---|
| ***F04C 2/26*** | (2006.01) |
| ***F04C 15/00*** | (2006.01) |
| ***F04C 2/08*** | (2006.01) |
| ***F04C 2/12*** | (2006.01) |

(52) U.S. Cl.

CPC ..... *F04C 2/086* (2013.01); *F04C 2/126* (2013.01); *F04C 15/0026* (2013.01); *F04C 2240/20* (2013.01); *F04C 2240/30* (2013.01); *F04C 2240/50* (2013.01); *F04C 2240/805* (2013.01); *F04C 2250/20* (2013.01)

(58) Field of Classification Search

CPC .... F04C 2/26; F04C 15/0026; F04C 15/0076; F04C 2240/76

See application file for complete search history.

(56) References Cited

U.S. PATENT DOCUMENTS

| | | | | |
|---|---|---|---|---|
| 8,821,141 | B2 * | 9/2014 | Helgeson | F04C 15/0073 418/104 |
| 2003/0059330 | A1 * | 3/2003 | Norman | F04C 2/126 418/206.1 |
| 2009/0304540 | A1 * | 12/2009 | Whittome | F04C 15/0076 418/104 |

* cited by examiner

*Primary Examiner* — Deming Wan

(74) *Attorney, Agent, or Firm* — Miller & Martin PLLC; Stephen J. Stark

(57) ABSTRACT

Lobe pumps have rings which can be located at least partially in at least one of cover plates and rotors, if not both to provide at least thrust bearings to space the rotors from the cover plates. Some rotors may have voids in ears to make the rotor lighter in weight with the voids potentially capped, symmetrically disposed, arcuately shaped and/or have other desirable features. Some rotors may have ears extending beyond cutouts which may extend beyond hubs, if not beyond hub extensions as well which may receive cover spigots thereabout. Some rings may act as radial bearings as well when located in the cover spigots.

18 Claims, 9 Drawing Sheets

ROTARY PUMP WITH ROTOR BEARING RING

FIELD OF THE INVENTION

The present invention relates to a rotary pump construction such as a positive displacement pump and more particularly to such pumps potentially having improved rotor constructions with at least one of easy to clean feature, voids in the rotor, improved rotor sealing characteristics and/or improved rotor bearing performance over prior art pumps.

BACKGROUND OF THE INVENTION

The applicant is the owner of at least U.S. Pat. Nos. 8,087,914, 9,017,052, and 9,377,021 for improved positive displacement pumps with rotors. These designs have been well received in the marketplace.

While these three designs have rotor pads on the faces that face the cover (and opposing side) in an effort to reduce wear on the rotors themselves, they do not specifically address sealing. Furthermore, the covers on these designs are typically secured with nuts such as nut 20 in U.S. Pat. No. 9,937,021 requiring a wrench for installation/removal.

In the field of food service, many pumps are regularly disassembled and cleaned. In order to accomplish this, nuts are removed with wrenches. Other tools may be required in such activities. The applicant believes there is a need for a pump which can be quickly disassembled potentially with no tools in a safe and effective manner such as for cleaning or other service such as rotor replacement, seal replacement, etc. and efficiently placed back in service.

SUMMARY OF THE INVENTION

It is an object of many embodiments of the present invention provide an improved rotary pump with improved sealing characteristics.

It is another object of many embodiments to provide an improved rotary pump which can have a rotor removed and/or replaced without the use of tools.

It is another object of many embodiments of the present invention to have an improved positive rotary pump with rotors shaped somewhat like a Star Wars™ TIE fighter which may receive a cover spigot internally into at least a portion of the rotors to then be adjacently disposed against a central hub with one or more rings intermediate thereto to provide a thrust bearing and/or seal.

It is another object of many embodiments of the present invention to provide a rotary pump having a cover plate with cover spigots extending into the cavity of a pump which receive end portions of parallel shafts internally thereto, preferably with a ring at an end of the spigots to provide at least one of a thrust bearing against the rotors, a seal, and a radial bearing for at least one of the shaft and rotor.

It is another object of many embodiments of the present invention to provide rings in ring channels in at least one of a cover, a cover spigot and a rotor for use in at least one of providing a thrust bearing, providing a sealing surface and/or providing a radial bearing.

Accordingly, in accordance with a presently preferred embodiment of the present invention, a rotary pump is providing having a rotor housing defining a cavity intermediate side walls, an end wall and a cover plate. An inlet and outlet communicate with the cavity. Parallel first and second shafts extend into the cavity from the end wall which rotate first and second rotors to provide pumping action (to direct fluid/material from the inlet to out the outlet).

Cover plates may, or may not, have cover spigots extending into the cavity. Rings could be installed at least partially into the cover, cover spigots and/or on the rotors themselves such as in a ring channel extending into at least one of the covers, cover spigots and/or the rotors of the various embodiments. In fact, the rings may extend at least partially from the ring channels. Additionally, first rings may be located along the cover or cover spigots while second rings may be located along the rotors with the first and second rings contacting one another in the cavity.

In accordance with the presently preferred embodiment of the present invention, a positive displacement pump, also known as a rotor pump, having parallel shafts with rotors thereon receive an input (at input) and then expel an output (an output) based on the rotation of the rotors has improvements over prior art constructions. Specifically, the rotors may have ears extending from a hub which is received on a shaft. For many embodiments, the hub does not extend the full length of the rotors on the shaft. Instead, cover spigots receive a portion of the shaft therein and extend up to the hub (or to a hub extension extending towards the cover spigot) along the shaft. With this embodiment, a portion of the rotor ears have a cutout to receive the cover spigots radially internally thereto. The cover spigots may also cooperate with and/or have a ring or insert ring adjacently disposed thereto which may contact the rotor and/or rotor ring which may be inset in a channel on the rotors so that the rings may provide at least one of a seal, a thrust bearing to stop axial movement of the rotors, shafts or gears, and/or a radial bearing to resist radial movement of the rotors, gears and/or shaft.

Additionally, by providing wing nuts instead of other nut constructions to hold the cover to the pump housing, possibly in combination with a swing arm design of the cover plate relative to the pump housing, the cover plate can be removed relative to the pump housing potentially with no tools to be swung open to access the cavity such as the rotors such for cleaning and/or other maintenance activities. This means that workers could quickly and efficiently open pumps without a need for tools to perform desired maintenance and restore the pumps to serve in a very time-efficient manner for at least some embodiments. Other advantages will be apparent from the enclosed figures and description.

Rotors may be improved for at least some embodiments by having voids in the ears, preferably voids symmetrically disposed about the hub. These voids may be encapsulated by capping cast or machined openings in the ears or otherwise provided. The voids may by arcuately shaped (or have other shapes) and there may be more than one void per ear.

Alternatively preferred embodiments may have planar rear cover plates (without cover spigots) which may potentially receive rings in ring channels to function similar to those described above. The rotors with such embodiments may be more traditional in shape, but some may preferably have ring channels in the hub to receive a ring at least partially therein.

BRIEF DESCRIPTION OF THE DRAWINGS

The accompanying drawings illustrate the preferred embodiments of the invention and, together with the description, serve to explain the invention. These drawings are offered by way of illustration and not by way of limitation.

DETAILED DESCRIPTION OF THE PREFERRED EMBODIMENT

Figure 1:
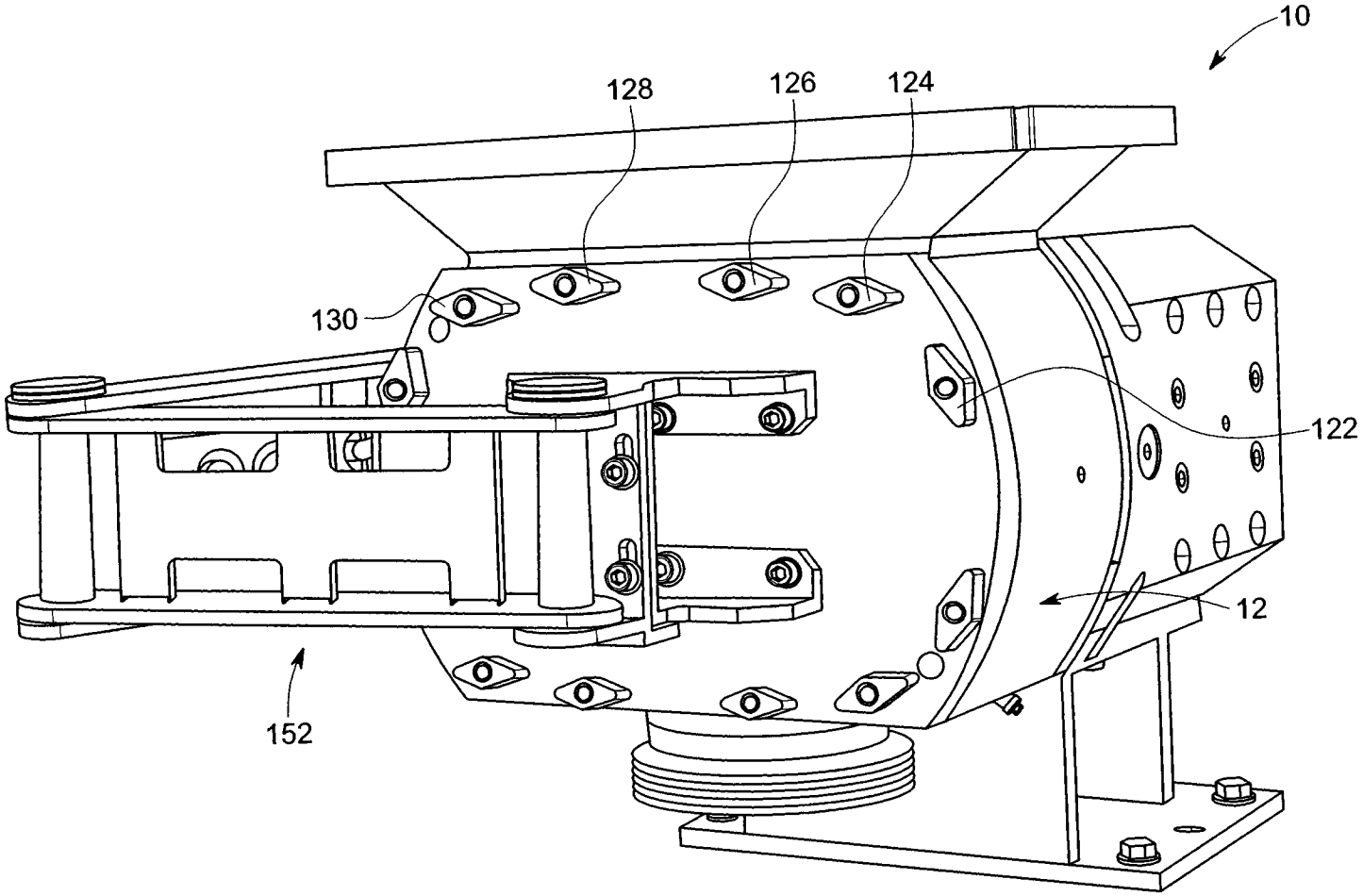
FIG. 1 is a front perspective view of the present preferred embodiment of the present invention in an operational configuration.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term module refers to a part of, or includes an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. In the example of a processor executing code, the term module includes memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

Figure 2:
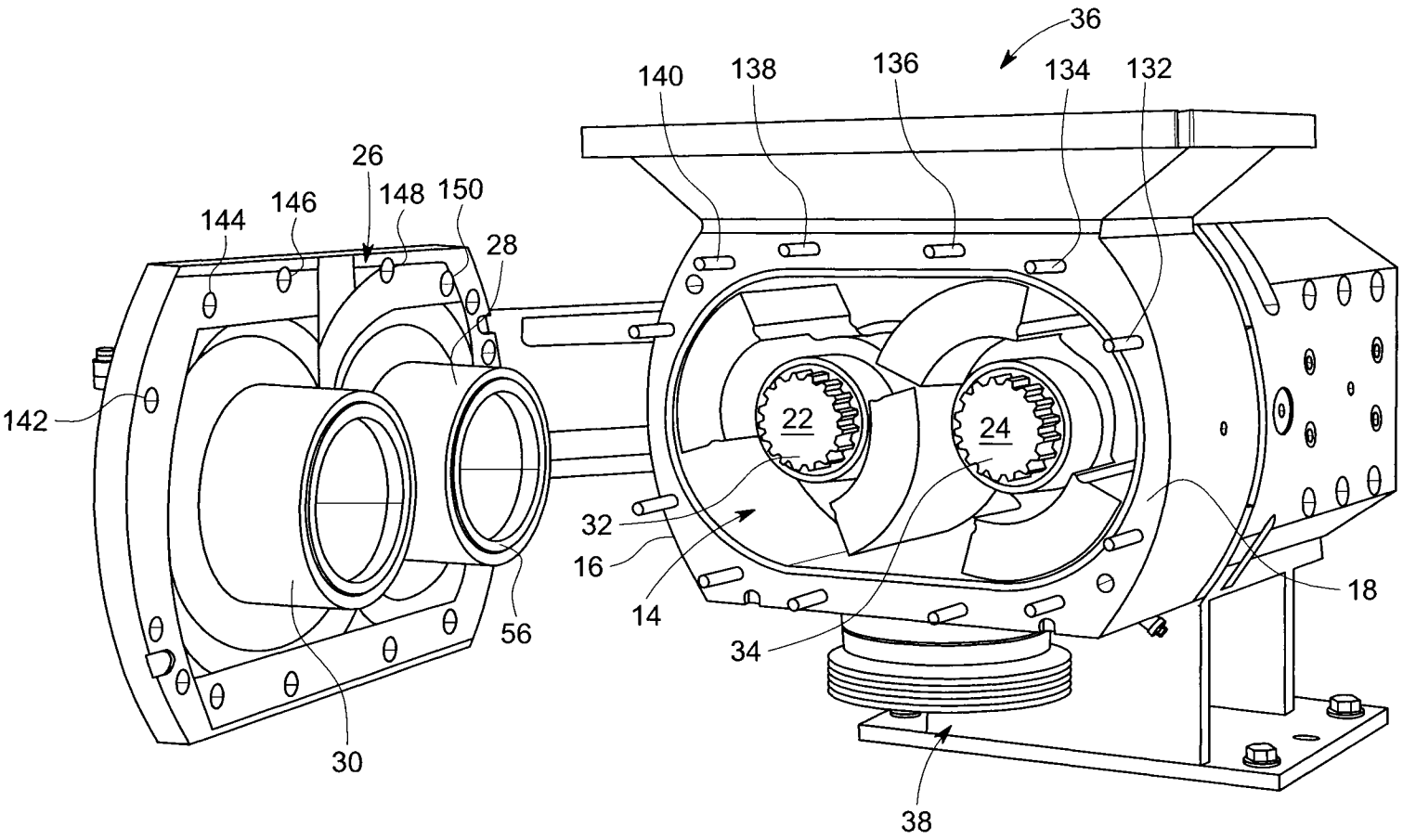
FIG. 2 is a front perspective view of the present invention shown in FIG. 1 in an open configuration.
Figure 3:
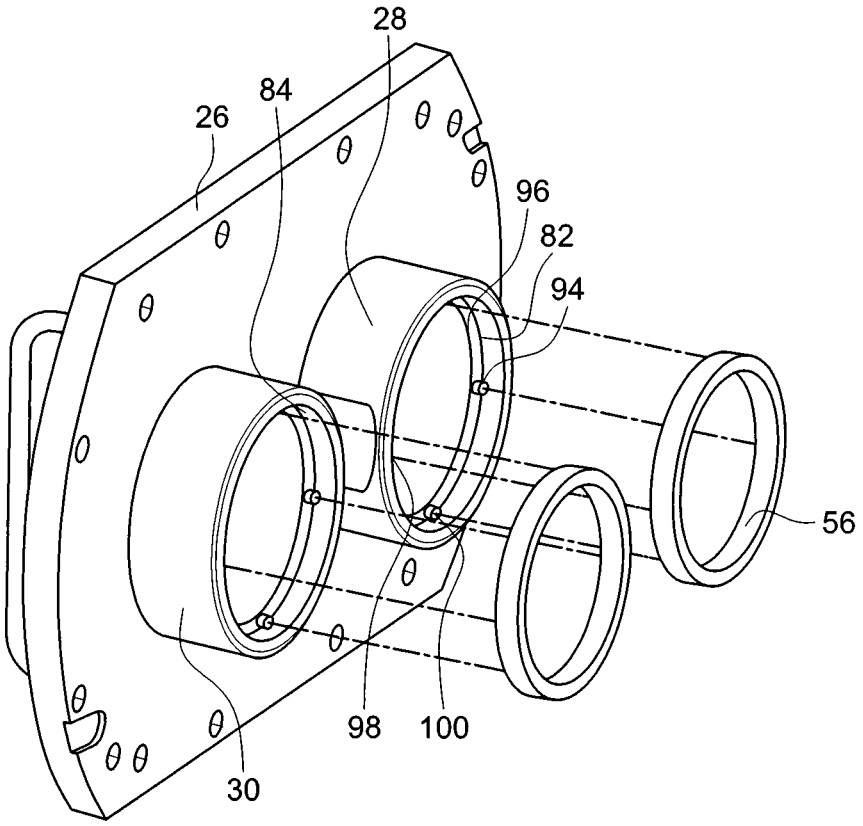
FIG. 3 is an exploded view of the cover plate of a first preferred embodiment shown in FIG. 2 in an open configuration.
Figure 4:
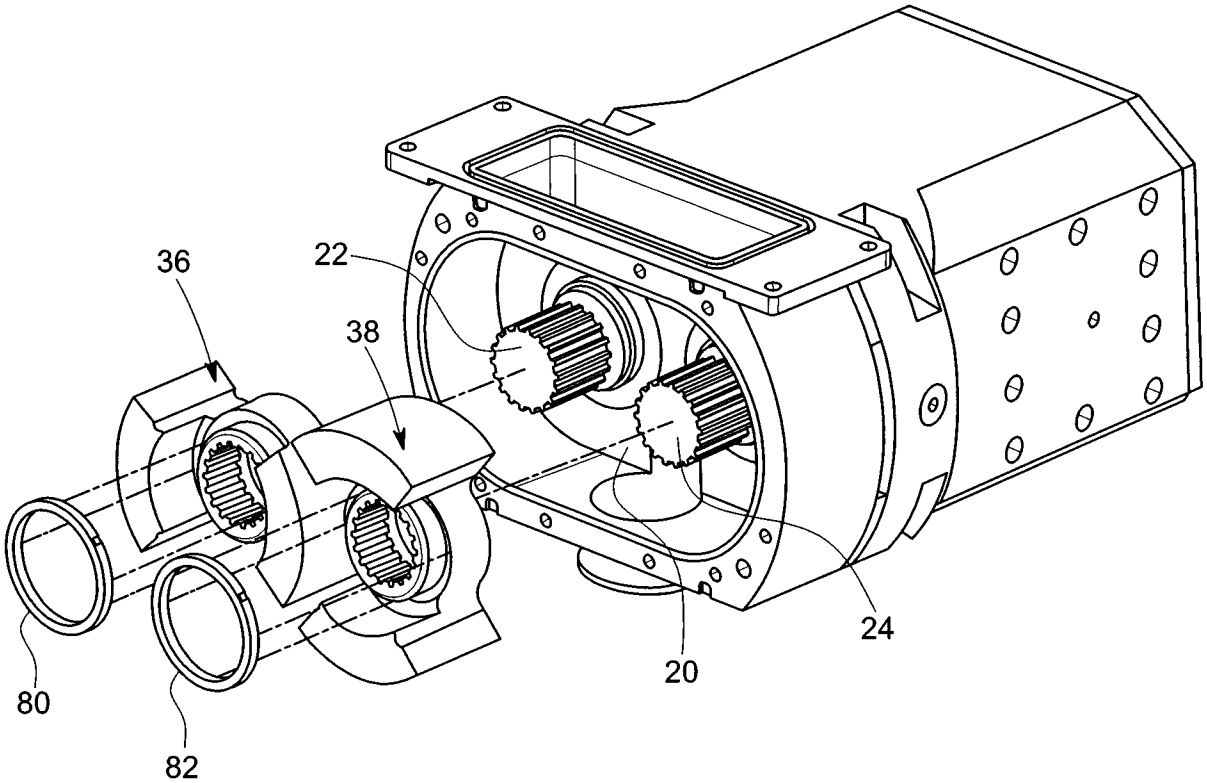
FIG. 4 is an exploded view of the of pump embodiment of FIGS. 2-3 without the cover as shown on FIGS. 2-3.

FIG. 1 shows a rotary lobe pump 10 having a rotor housing 12 defining a cavity 14 shown on FIG. 2 intermediate side walls 16 and 18, an end wall 20 and a cover plate 26. Into the cavity 14 from the end wall preferably extends first and second shafts 22, 24 which are parallel shafts. The cover plate 26 is preferably located opposite the end wall 20 and will be discussed below. One embodiment of cover plate 26 preferably has first and second cover spigots 28, 30, which receive ends 32, 34 of the first and second shafts 22, 24 therein as will be explained in further detail below. In fact, the first and second cover spigots 28, 30, preferably receive and surround ends 32 and 34 of first and second shafts 22, 24, respectively. The pump 10 further comprises an inlet 36 and an outlet 38 (or vice versa) which may extend through the side walls 16, 18 and/or other portion of the pump housing 12. Mounted on the first and second shafts 22, 24 are preferably first and second rotors 36 and 38 provided as a pair of rotors 36, 38. Rotors 36 and 38 are shown as having splined hubs as will be explained in further detail below which can cooperate with splined exterior surfaces of the first and second shafts 22, 24 as would be understood by those of ordinarily skill in the art for at least some embodiments. Other methods of connecting the rotors 36, 38 to shafts 22, 24 could be employed with still other embodiments.

Figure 5:
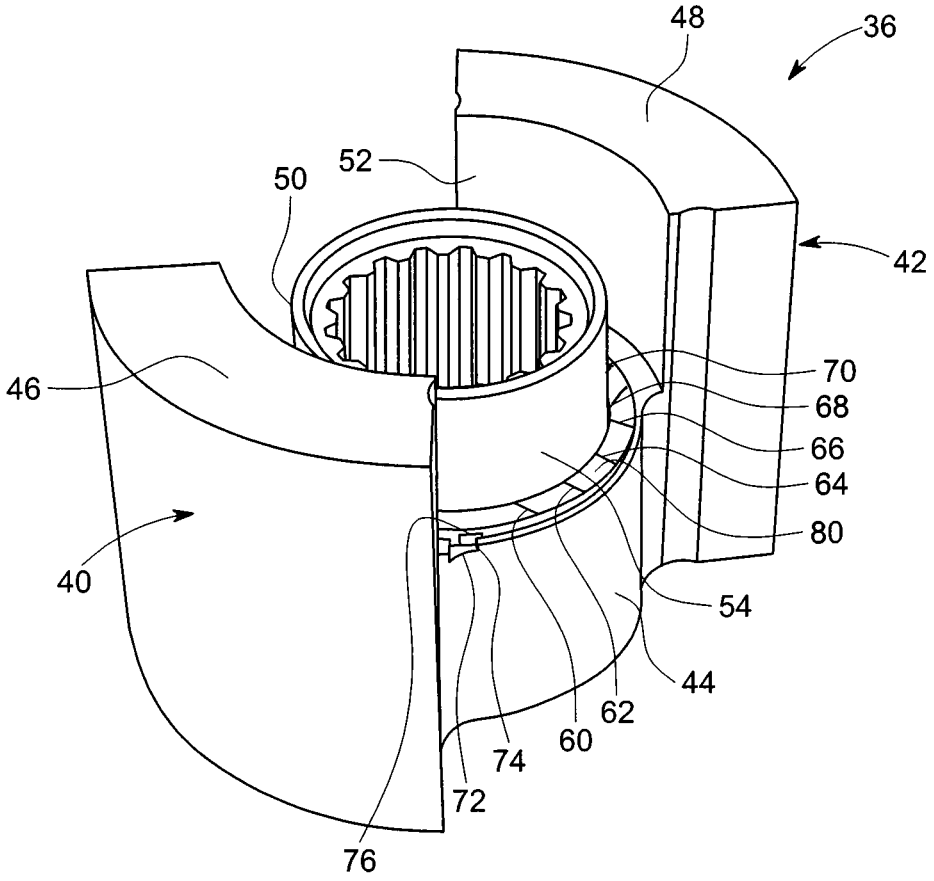
FIG. 5 is a top perspective view of a rotor as shown in FIGS. 2 and 4.

The respective rotors such as 36 and 38 are shown in FIG. 5 as first rotor 36. Each of the first and second rotors 36, 38 preferably has first and second ears 40, 42 which extend from a hub 44. The ears 40, 42 may have faces 46, 48, respectively which face the cover plate 26 when installed. Portions of the ears 40, 42 preferably may be spaced by first and second cutouts 50, 52 from first and second shafts 22, 24 when installed. In fact, the first and second cover spigots 28, 30 may be received radially within first and second cutout or ring channels 50, 52, respectively, as will be explained in further detail below. The hub 44 and/or possibly a hub extension 54 can assist in connecting the rotors 36, 38 to the first and second shafts 22, 24, respectively. First rings such as first ring 56 may be received at least partially within a ring channel 82, 84 which may be useful in securing and retaining the first ring 56 to the cover plate 26 such as in the cover spigots 28, 30. First ring 56 (as well as second ring 80 shown in FIG. 5 which may be similar or dissimilar in construction to first ring 56) may also have parallel grooves 60, 62, 64, 66 and/or others extending in a first direction as well as a second set of grooves 68, 70, and/or others with the set potentially perpendicular to the first set of grooves 60, 62, 64, 66. The grooves 60-70 etc. may be utilized for lubrication and/or other purposes. Ring channels 82, 84 preferably circumnavigates the cover spigots 28, 30 internal to an outer perimeter of the cover spigots 28, 30.

A slot 72 in the second ring 80 is shown visible through notch 74 in the hub 44 with the slot 72 terminally at lip 76 so that a new second ring 80 may be relatively easily removed from the hub 44 by inserting a screwdriver or other device through the notch 74 into the slot 72 against the lip 76 and then lifting upward. Other embodiments may have other constructions, but this construction has been found to work particularly well for at least some embodiments.

Figure 6:
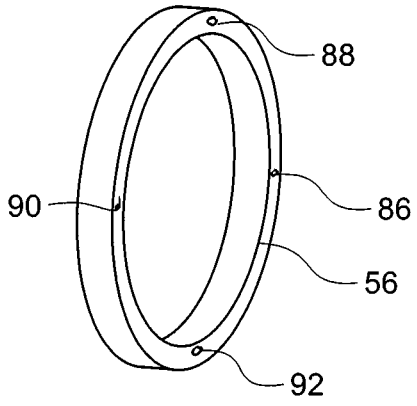
FIG. 6 is a side perspective view of a ring as shown in FIG. 3.

One of ordinary skill in the art may see that the cutouts or ring channels 50, 52 may extend radially about the hub extension 54 and the ears 40, 48 may extend radially externally about the hub extension 54. While a ring similar to the first ring 56 is shown in FIG. 5 as a second ring 80 being adjacent to the hub 44 if not retained to the hub 44 to be secured to the rotor 36 and/or 38, a first ring 56 may be adjacent if not connected to the cover spigots 28, 30 such as in first and second spigot ring channels 82, 84, etc. with the ring of FIG. 6 which could be of similar construction to the second ring 80 or vice versa of the first ring 56 depending on which ring 56 or 80 is which. Bores such as bores 86, 88, 90, 92 in first ring 56 may cooperate with dowels 94, 96, 98, 100, etc. (or vice versa) so as to secure the first rings 56 to the cover spigots 28, 30. Other connections could be provided with other embodiments.

Once again, exterior slots such as slot 72 shown in the second ring 80 may be provided in the first ring 56 and be useful to assist in removing an installed first ring 56 for at least some embodiments. There may be other ways to assist in removing a first or second ring 56, 80 as well. Second rings 80 may also have various lubrication channels, etc as illustrated or not. It may be that only one of first and/or second rings 56, 80 are utilized in various embodiments, but still other embodiments may utilize both first and second rings 56, 80, so that first and second rings 56, 80 may then contact one another when installed as would be understood by those ordinarily skilled in the art to act as at least one of seal(s) thrust having to axially locate rotors relative to slots 22, 24 and/or adding seal(s) to limit radial movement of shafts 22, 24 and/or rotors 36, 38. One of the first ring 56 and second ring 80 are preferably held stationary with the cover plate 26 or 160 while the other rotates with the rotor 36, 38 (or 186, 188).

Figure 7:
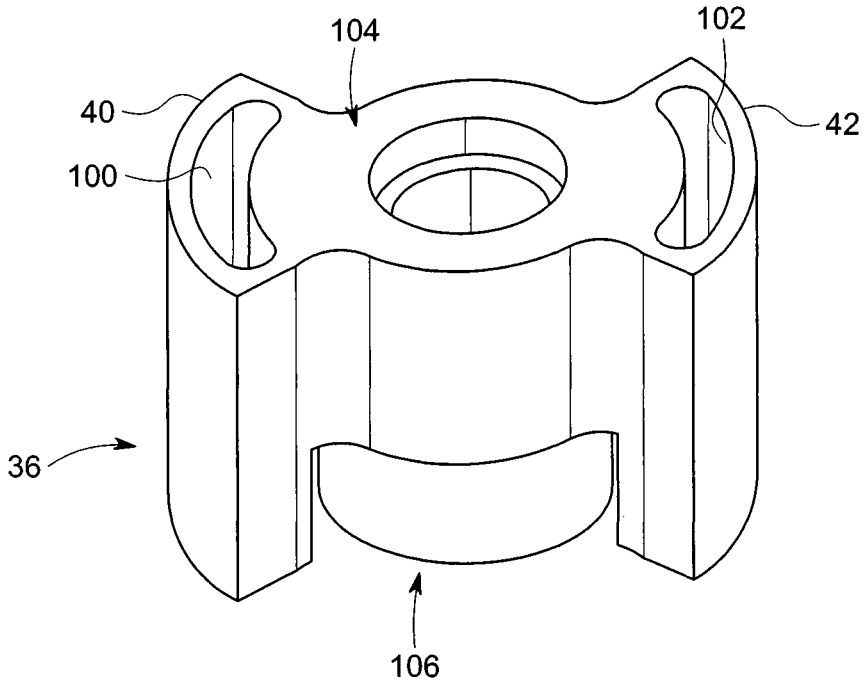
FIG. 7 is a rear perspective view of the rotor of FIGS. 2, 4-5.
Figure 8:
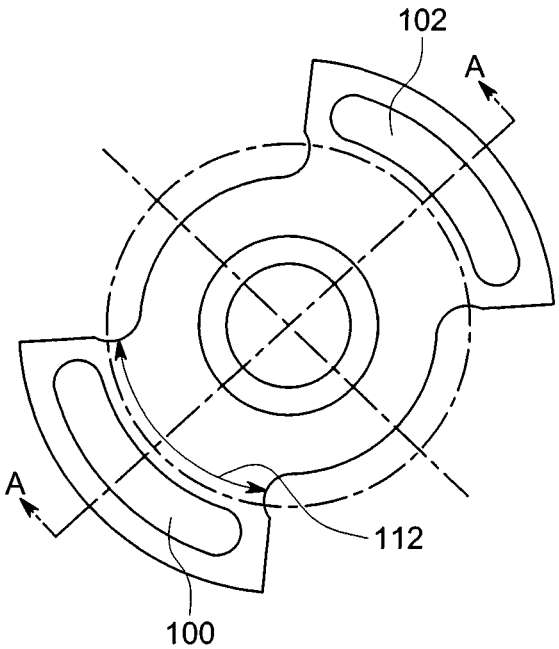
FIG. 8 is a rear plan view of the rotor shown in FIG. 7 without caps on the voids.
Figure 9:
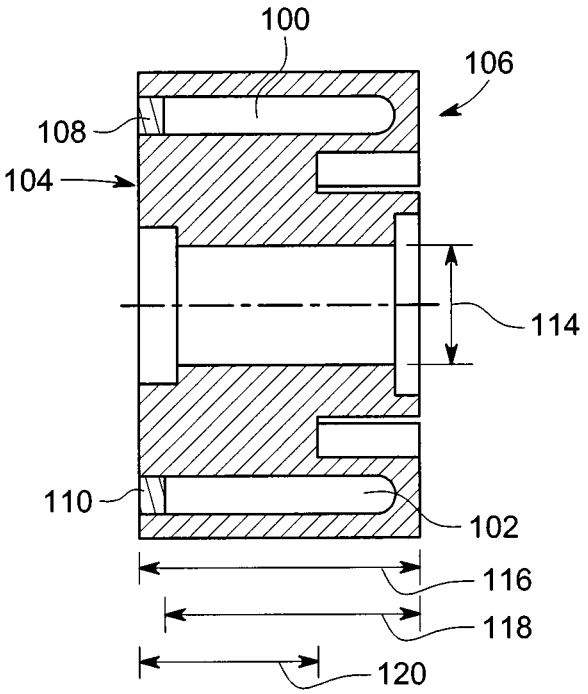
FIG. 9 is a side cross-sectional view taken along the line A-A in FIG. 8 with the caps installed.
Figure 10:
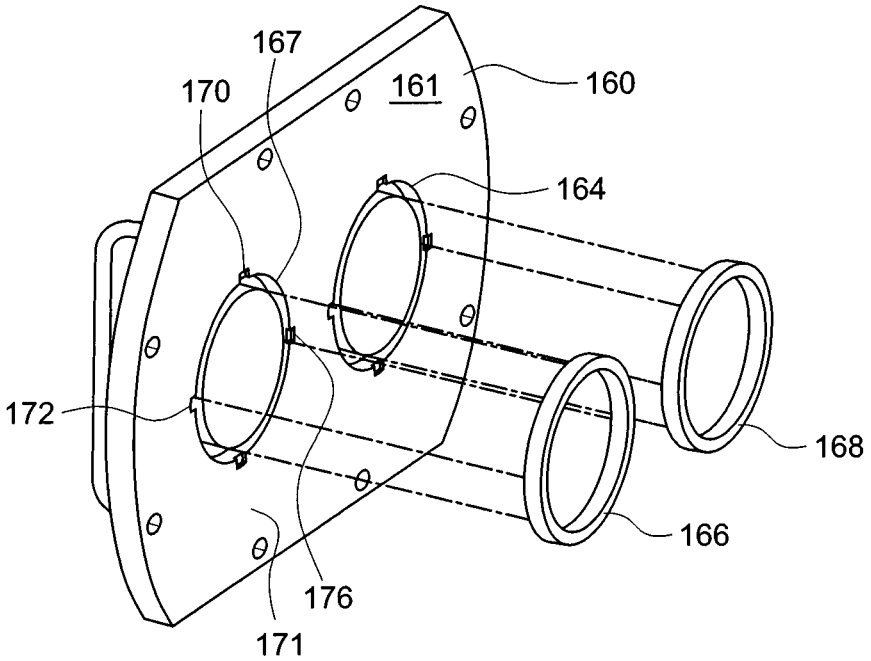
FIG. 10 is an exploded view of the cover plate of a second preferred embodiment shown in FIG. 2 in an open configuration.
Figure 11:
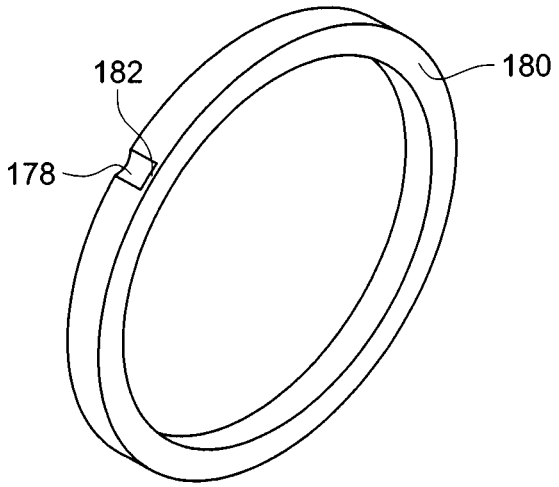
FIG. 11 is a side perspective view of a ring as is illustrated in FIGS. 4, 5 and 10.

FIG. 7 shows a rotor 36 of a presently preferred embodiment 100, 102 (or others) having first and second voids 100, 102. Voids 100, 102 can also be seen in FIGS. 8 and 9. The voids preferably extend, at least for some embodiments from a rear 104 which could be adjacent to the end plate 20 as opposed to a front 106 which faces the cover plate 26 of at least some embodiments. Other embodiments may have the voids 100, 102 extend inwardly from the front 106 instead of from the rear as shown or from another direction. Still other embodiments may have voids that extend completely through the ears 40, 42. For many embodiments, the voids 100, 102 may be cast and/or machined into metal and/or other material(s) of rotors 36, 38 or otherwise provided with various other constructions. For many embodiments, caps 108, 110 may be installed at the rear 104 or otherwise so as to encapsulate voids 102, 104 as encapsulated voids internal to the rotors 36, 38.

Voids 100 and 102 can take various shapes and are preferably disposed in the ears 40, 42. Voids 100, 102 may be arcuately disposed, as illustrated, possibly with a single void 100 or 102 per ear 40, 42, or there could be multiple voids 100 and/or 102 per ear 40, 42, of various shapes, depending on the construction of the embodiment. The voids 100, 102 in the arcuate constructions illustrated may have a with 112 which is longer than the diameter 114 of the shaft when installed, for at least some embodiments. Voids 100 and 102 are also shown extending a depth 116 and 118 depending on whether or not the caps 110 are included greater than a depth 120 of the hub 44. Other depths could be provided with other embodiments.

FIG. 1 shows a plurality of wing nuts 122-130 and others which are utilized to connect to threaded shafts 132, 134, 56, 138, 140 and others, extending from a front of side walls 16, 18 of the pump housing 12 through bores 42-150 and others in the cover plate 26. These wing nuts 122-130 and others may be hand tightened by an operator and also hand loosened so as to remove the wing nuts 122-130 to then remove the cover plate 26 relative to the housing 12 possibly utilizing pivoting swing arm 152. Swing arm 152 may protect the cover plate 26 when removed along with the threaded rods 132-140 and also the operator which may otherwise inadvertently drop the cover plate 26 on their feet or otherwise injure themselves or the cover plate 26, threaded nuts 132-140, or due to lifting and twisting with the cover plate 26.

Figure 12:
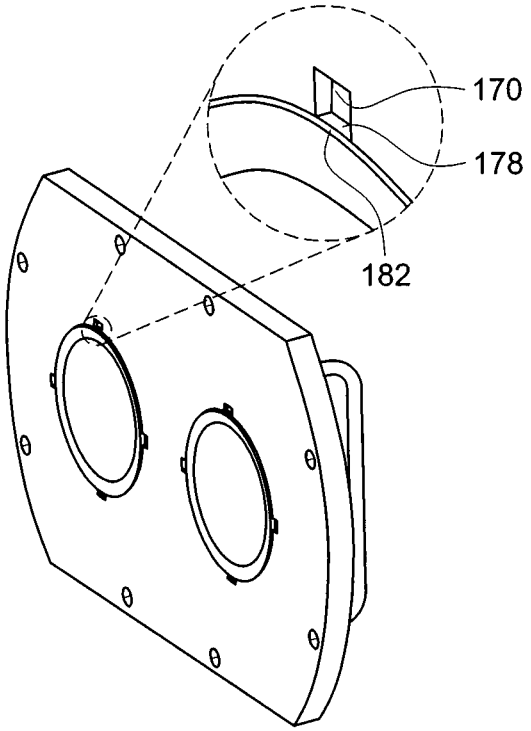
FIG. 12 is a perspective view of the cover with a ring installed of the embodiment of FIG. 10.

FIGS. 10-13 show an alternative embodiment of a pump 300 cover plate 160 having ring channels 162, 164 along clear surface 161 which receive first rings 166, 168 at least partially therein. Notches 170, 172, 174, 176 may be useful radially external (or internal) to the ring channels 162, 164 possibly to even cooperate with slots such as slot 178 in a first ring 180 radially exterior surface so that after a first ring 180 is installed such as shown in FIG. 12. A flathead screwdriver or other device could be inserted into notch 170 and into slot 178 to lift up on lip 182 to assist in removing the ring 180 from the groove 162. Not all cover plates 160 necessarily have the swing arm 152 such as the embodiment shown in FIGS. 10-13. The first rings 166, 168 connect into the cover plate 160 instead of into other spigots which are not present in this embodiment. First rings 166, 168 are illustrated at least partially within ring channels 162, 164 and are preferably secured to the cover plate 160.

Figure 13:
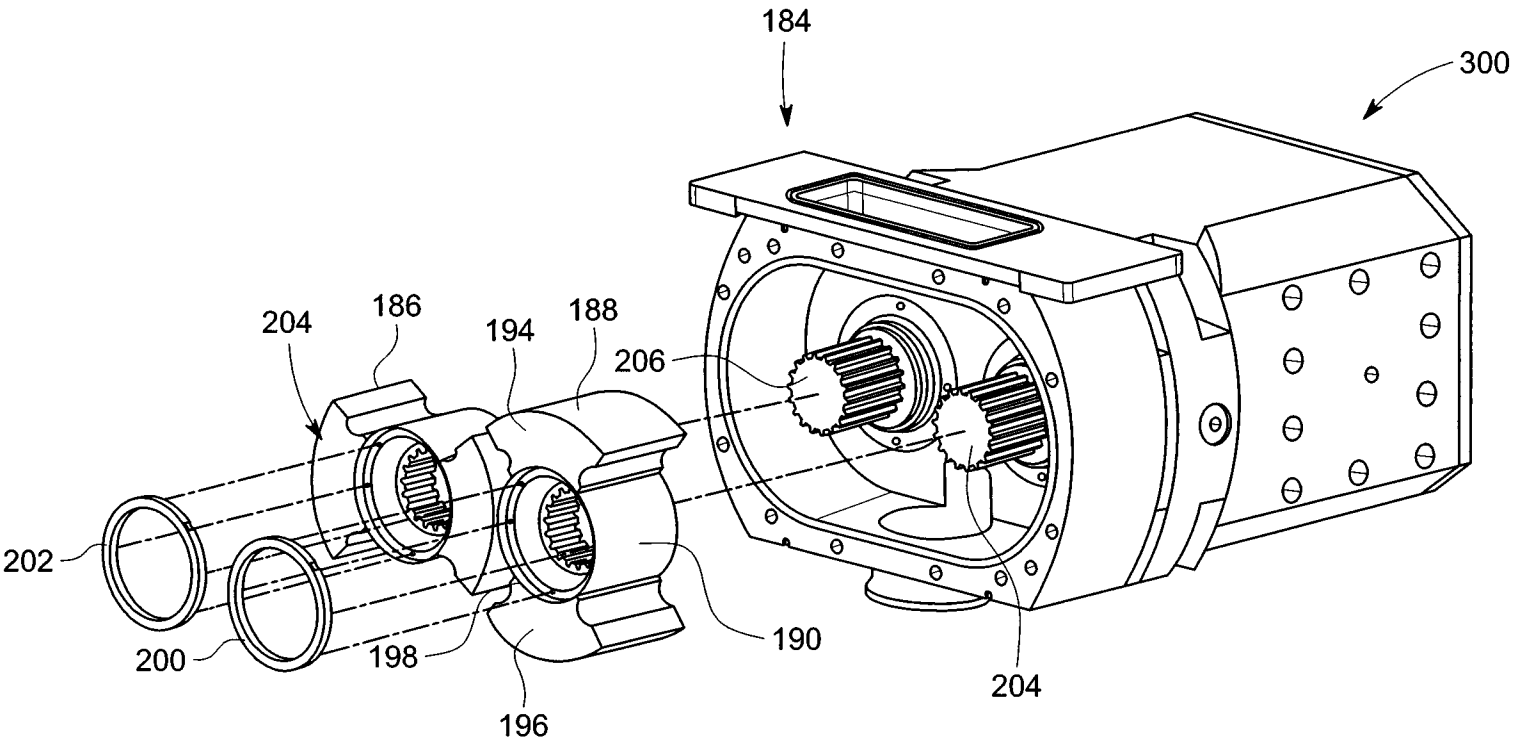
FIG. 13 is an exploded view of the pump embodiment of FIGS. 10-12 without the cover plate installed.

Additionally, FIG. 13 shows an exploded view of a pump housing 184 with rotors 186 and 188 which are more of a traditional shape with a hub 190 having a thickness 192 which may be roughly the same thickness as the ears 194, 196. The embodiment may have a ring channel 198 (illustrated as round) which receives a second ring 200 at least partially therein which could be similarly constructed or not as first rings 180, 56 and/or others such as by having a slot in an exterior wall surface to potentially assist in removal once installed.

In the embodiment of the pump 300 of FIGS. 10-13, the first rings 166, 168 may contact second rings 200, 202, respectively, to assist in sealing and/or provide a radial thrust bearing relative to the rotors so that the rotor faces 204 do not contact the cover plate 160 but instead, first rings 166, 168 contact second rings 200, 202, respectively, to provide a thrust bearing for at least the rotors 186, 188, and also the shafts 204, 206. First rings 166 may be used independent of second rings 204, 206, and vice versa. First rings 166, 168 may be secured to cover plate 160 and do not rotate while second rings 200, 202 may be secured to rotors 186, 188 and rotate therewith in many embodiments. Remember either first or second rings 166, 168 or 200, 202 or both may be utilized with the various embodiments.

As one can see from the drawings and the description, there are various embodiments that can be created utilizing the technology provided herein. Some embodiments may have rings and grooves on either the cover plate, cover spigots and/or rotors. Some rotors may have hubs connected to ears potentially with cutouts spacing a portion of the ears from each other about a shaft which could then receive the cover spigots therein. Some rotors may have voids therein of various constructions and shapes as shown and described herein and as would be understood by those who are ordinarily skilled in the art.

Numerous alterations to the structures herein disclosed will suggest themselves to those skilled in the art. However, it is to be understood that the present disclosure relates to the preferred embodiment of the invention for which is for purposes of illustration only and not to be construed as a limitation of the invention. All such modifications which do not depart from the spirit of the invention are intended to be included within the scope of the appending claims.

What is claimed is:

1. A rotary lobe pump comprising:

a rotor housing assisting defining a cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected to a central hub with the hub connected to the respective first and second shaft; and first rings intermediate each of the first and second rotors and the cover plate located at least partially in a first ring groove circumnavigating one of the cover plate and rotor, said first rings providing at least a thrust bearing spacing the faces of the first and second rotors from the cover plate; and (a) cutouts spacing portions of the ears from the shaft and (b) cover spigots extending from the cover plate, said cover spigots receiving and surrounding portions of the first and second shafts and extending into the cutouts.

2. The rotary lobe pump of claim 1 wherein the cutout extends a depth of at least ⅓ of a depth of the ears.

3. The rotary lobe pump of claim 2 further comprising voids in the ears.

4. The rotary lobe pump of claim 3 wherein at least some of the voids have a depth greater than a depth of the hub.

5. The rotary lobe pump of claim 1 wherein the first ring groove is located in the hub radially externally to a hub extension extending from the hub toward the cover plate while circumnavigating the shaft, and the hub extension is circumnavigated by the cover spigot.

6. The rotary lobe pump of claim 5 further comprising second rings, and the first rings contact the second rings assisting in spacing the faces of the ears from the cover plate.

7. The rotary lobe pump of claim 6 wherein the second rings are located in ring grooves of the rotor and the first rings are located in the first ring grooves connected to the cover plate.

8. The rotary lobe pump of claim 6 wherein the first rings at least assist in radially restraining at least one of the shafts and hub extensions.

9. A rotary lobe pump comprising:

a rotor housing assisting defining a cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected to a central hub with the hub connected to the respective first and second shaft; and first rings intermediate each of the first and second rotors and the cover plate located at least partially in a first ring groove circumnavigating one of the cover plate and rotor, said first rings providing at least a thrust bearing spacing the faces of the first and second rotors from the cover plate; and voids in the ears.

10. The rotary lobe pump of claim 9 wherein the voids in the ears are symmetrically disposed about the hub.

11. The rotary lobe pump of claim 9 wherein the voids are capped to be enclosed within the ears.

12. The rotary lobe pump of claim 9 wherein the at least some of the voids extend arcuately within the ears at least a distance of a radius of the shaft.

13. A rotary lobe pump comprising:

a rotor housing assisting defining a cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected to a central hub with the hub connected to the respective first and second shaft; and first rings intermediate each of the first and second rotors and the cover plate located at least partially in a first ring groove circumnavigating one of the cover plate and rotor, said first rings providing at least a thrust bearing spacing the faces of the first and second rotors from the cover plate; and second rings, and the first rings contact the second rings assisting in spacing the faces of the ears from the cover plate.

14. A rotary lobe pump comprising:

a rotor housing assisting defining a cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected to a central hub with the hub connected to the respective first and second shaft; and first rings intermediate each of the first and second rotors and the cover plate located at least partially in a first ring groove circumnavigating one of the cover plate and rotor, said first rings providing at least a thrust bearing spacing the faces of the first and second rotors from the cover plate; and the first ring has a ring slot on a radial exterior surface terminating at a lip.

15. The rotary lobe pump of claim 14 further comprising a notch in one of the cover plate and rotor providing access to the slot and lip to assist in removal of the first ring.

16. A rotary lobe pump comprising:

a rotor housing assisting defining a cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected to a central hub with the hub connected to the respective first and second shaft; and first rings intermediate each of the first and second rotors and the cover plate located at least partially in a first ring groove circumnavigating one of the cover plate and rotor, said first rings providing at least a thrust bearing spacing the faces of the first and second rotors from the cover plate; and channels extending into at least one face of the first ring directed away from of the cover and end plate from the at least one face.

17. The rotary lobe pump of claim 16 wherein at least some of the channels are parallel with each other.

18. A rotary lobe pump of comprising:

a rotor housing assisting defining a cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected to a central hub with the hub connected to the respective first and second shaft; and voids in the ears of the shafts extending from a face of the ear at least ⅓ of a depth of the ears, and first rings intermediate each of the first and second rotors and the cover plate located at least partially in a first ring groove circumnavigating one of the cover plate and rotor, said first rings providing at least a thrust bearing spacing the faces of the first and second rotors from the cover plate.

* * * * *